US010060686B2

(12) United States Patent
Liu et al.

(10) Patent No.: US 10,060,686 B2
(45) **Date of Patent: *Aug. 28, 2018**

(54) PASSIVE RADIATIVE DRY COOLING MODULE/SYSTEM USING METAMATERIALS

(71) Applicant: Palo Alto Research Center Incorporated, Palo Alto, CA (US)

(72) Inventors: Victor Liu, Mountain View, CA (US); Bernard D. Casse, Saratoga, CA (US); Armin R. Volkel, Mountain View, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 345 days.

This patent is subject to a terminal disclaimer.

(21) Appl. No.: 14/740,051

(22) Filed: Jun. 15, 2015

(65) Prior Publication Data

US 2016/0363394 A1 Dec. 15, 2016

(51) Int. Cl.
*F28F 9/22* (2006.01)
*F28F 13/18* (2006.01)
(Continued)

(52) U.S. Cl.
CPC ..... *F28F 9/22* (2013.01); *F28B 1/06* (2013.01); *F28F 13/18* (2013.01); *F28F 3/00* (2013.01);
(Continued)

(58) Field of Classification Search
CPC ..... F28F 9/22; F28F 13/18; F28F 2013/001; F28F 2245/06; F28F 3/00; F28B 1/06
(Continued)

(56) References Cited

U.S. PATENT DOCUMENTS 3,929,594 A 12/1975 Fromson
4,065,364 A 12/1977 Fromson
(Continued)

FOREIGN PATENT DOCUMENTS

CN 102778144 11/2012
CN 103312042 A 9/2013
(Continued)

OTHER PUBLICATIONS

Pratap et al., "Plasmonic Properties of Gold-Coated Nanoporous Anodic Alumina With Linearly Organized Pores," Pramana—J. Phys. (Dec. 2014), vol. 83, No. 6, pp. 1025-1033.
(Continued)

*Primary Examiner* — Jianying Atkisson
*Assistant Examiner* — Joel Attey
(74) *Attorney, Agent, or Firm* — Bever, Hoffman & Harms, LLP

(57) ABSTRACT

A passive radiative cooling system in which an ultra-black emitter includes metamaterial nanostructures disposed on the top surface of a metal sheet, and a conduit structure channels the flow of coolant against a bottom surface of the metal sheet. The metamaterial nanostructures (e.g., tapered nanopores) are configured to dissipate heat from the coolant in the form of emitted radiant energy having wavelengths/frequencies that fall within known atmospheric transparency windows (e.g., 8-13 μm or 16-28 μm), the emitted radiant energy being transmitted through a reflective layer into cold near-space. The ultra-black emitter is formed using a modified Anodic Aluminum Oxide (AAO) self-assembly technique followed by electroless plating that forms metal-plated tapered nanopores, and the reflective layer includes a distributed Bragg reflector. The cooling system is made scalable by way of modular cooling units (modules) that are
(Continued)

configured for connection in series and parallel to form dry cooling systems suitable for large power plants.

15 Claims, 6 Drawing Sheets

(51) Int. Cl.
*F28B 1/06* (2006.01)
*F28F 3/00* (2006.01)
*F28F 13/00* (2006.01)

(52) U.S. Cl.
CPC ..... *F28F 2013/001* (2013.01); *F28F 2245/06* (2013.01)

(58) Field of Classification Search
USPC ..... 165/133, 104.26, 104.33
See application file for complete search history.

(56) References Cited

U.S. PATENT DOCUMENTS

| | | | | |
|---|---|---|---|---|
| 4,315,873 | A | 2/1982 | Smith et al. | |
| 4,361,630 | A * | 11/1982 | Johnson, Sr. | C23C 18/36 126/908 |
| 4,779,000 | A | 10/1988 | Ing | |
| 5,043,739 | A | 8/1991 | Logan et al. | |
| 5,712,166 | A | 1/1998 | Broan | |
| 5,905,263 | A | 5/1999 | Nishizawa | |
| 6,828,675 | B2 * | 12/2004 | Memory | H05K 7/20681 165/104.33 |
| 8,621,245 | B2 | 12/2013 | Shearer et al. | |
| 8,680,945 | B1 | 3/2014 | Wang | |
| 2002/0180639 | A1 | 12/2002 | Rickett | |
| 2004/0207486 | A1 | 10/2004 | York | |
| 2004/0238751 | A1 | 12/2004 | Penn | |
| 2005/0178533 | A1 * | 8/2005 | Minamitani | G06F 1/203 165/104.33 |
| 2006/0234505 | A1 | 10/2006 | Asano et al. | |
| 2008/0049228 | A1 | 2/2008 | Chan | |
| 2009/0207000 | A1 | 8/2009 | Mickle et al. | |
| 2009/0220802 | A1 | 9/2009 | Faber et al. | |
| 2009/0284351 | A1 | 11/2009 | Rossman et al. | |
| 2011/0303850 | A1 | 12/2011 | Barillon | |
| 2011/0309686 | A1 | 12/2011 | Scherbenski et al. | |
| 2012/0133547 | A1 | 5/2012 | MacDonald et al. | |
| 2012/0314541 | A1 | 12/2012 | Matsuura | |
| 2013/0076570 | A1 | 3/2013 | Lee et al. | |
| 2013/0187830 | A1 | 7/2013 | Warnick et al. | |
| 2014/0110263 | A1 * | 4/2014 | Barbier | C25D 11/08 205/50 |
| 2014/0131023 | A1 * | 5/2014 | Raman | B64G 1/50 165/185 |
| 2014/0355381 | A1 | 12/2014 | Lai et al. | |
| 2015/0214927 | A1 | 7/2015 | Greene et al. | |
| 2015/0236551 | A1 | 8/2015 | Shearer et al. | |
| 2015/0276489 | A1 | 10/2015 | Cumming | |
| 2015/0380973 | A1 | 12/2015 | Scheb | |
| 2016/0145214 | A1 | 5/2016 | Douce | |
| 2016/0181867 | A1 | 6/2016 | Daniel et al. | |
| 2016/0254844 | A1 | 9/2016 | Hull et al. | |
| 2016/0331054 | A1 | 11/2016 | Coza | |
| 2016/0336198 | A1 | 11/2016 | Singleton et al. | |
| 2016/0359378 | A1 | 12/2016 | Kuhn et al. | |
| 2017/0234168 | A1 * | 8/2017 | Scholz | F01K 9/003 60/690 |

FOREIGN PATENT DOCUMENTS

| | | |
|---|---|---|
| WO | 2007015281 | 2/2007 |
| WO | 2013039926 | 3/2013 |
| WO | 2015038203 | 3/2015 |

OTHER PUBLICATIONS

Noh et al., Highly Self-Assembled Nanotubular Aluminum Oxide by Hard Anodization, (Jan. 29, 2011), J. Mater. Res., vol. 26, Issue 2, pp. 186-193.
Aoyama, Takahiko et al. "Energy response of a full-energy-absorption neutron spectrometer using boron-loaded liquid scintillator BC-523", Nuclear Instruments and Methods in Physics Research A 333 (1993) 492-501, 10 pages.
Flaska, Marek et al., "Digital pulse shape analysis for the capture-gated liquid scintillator BC-523A", Nuclear Instruments and Methods in Physics Research A 599 (2009) 221-225, 5 pages.
Vanier, Peter E., et al., "Directional detection of fission-spectrum neutrons", 1-4244-1302-8/07, 2007 IEEE, 5 pages.
Vanier, Peter E., et al., "Calibration and Testing of a Large-Area Fast-Neutron Directional Detector", Brookhaven National Laboratory, BNL-79632-2007-CP, 8 pages.
Mascarenhas, Nicholas, et al., "Directional Neutron Detectors for Use with 14 MeV Neutrons", Sandia Report, SAND2005-6255, printed Oct. 2005, 32 pages.
Mirenda, Martin, et al., "Ionic liquids as solvents for liquid scintillation technology, Cerenkov counting with 1-Butyl-3-Methylimidazolium Chloride", Radiation Physics and Chemistry 98 (2014) 98-102, 5 pages.
Swiderski, L., et al., "Further Study of Boron-10 Loaded Liquid Scintillators for Detection of Fast and Thermal Neutrons", IEEE Transactions on Nuclear Science, vol. 57, No. 1, Feb. 2010, 6 pages.
Juan Li et al., "Facile Method for Modulating the Profiles and Periods of Self-Ordered Three-Dimensional Alumina Taper-Nanopores," ACS Appl. Mater. Interfaces 2012, 4, 5678-5683.
Juan Li et al., "Tailoring Hexagonally Packed Metal Hollow-Nanocones and Taper-Nanotubes by Template-Induced Preferential Electrodeposition," ACS Appl. Mater. Interfaces 2013, 5, 10376-10380.
Rephaeli, et al., "Ultrabroadband Photonic Structures to Achieve High-Performance Daytime Radiative Cooling," Nano Lett. (2013) vol. 13, pp. 1457-1461 (Year: 2013).
Hua et al., "Efficient Photon Management with Nanostructures for Photovoltaics," Nanoscale (2013), vol. 5, pp. 6627-6640 (Year: 2013).

* cited by examiner

PASSIVE RADIATIVE DRY COOLING MODULE/SYSTEM USING METAMATERIALS

FIELD OF THE INVENTION

This invention relates to dry cooling systems, and in particular to scalable passive radiative cooling systems for power plants.

BACKGROUND OF THE INVENTION

Large cooling systems play an important role in the generation of electricity. Most power plants generate electricity by way of converting a coolant (typically water) into a heated gaseous state (e.g., steam) using a heat source (e.g., a nuclear reactor core, a gas/coal/oil furnace, or a solar concentrator), and then passing the heated gaseous coolant through a generator (i.e., a rotating machine that converts mechanical power into electrical power). Before the coolant exiting the generator can be returned to the heat source, the coolant must be entirely reconverted from its gaseous state to its liquid state, which typically involves dissipating sufficient heat from the coolant to drop the coolant's temperature below its boiling point temperature. Due to the large volumes of coolant used in large power plants, this cooling function is typically performed by piping the coolant leaving the generators to large cooling systems disposed outside the power plant, whereby heat from the coolant is harmlessly dissipated into the surrounding environment. Failure to fully reconvert the coolant to its liquid state before returning to the power plant significantly reduces the power plant's efficiency. Hence, large cooling systems play and important role of in the generation of electricity.

Cooling systems can be categorized into two general classes: wet cooling systems that consume water (i.e., rely on evaporation to achieve the desired cooling power), and dry cooling systems that utilize convection or radiation to remove heat without consuming water. Generally speaking, a dry cooling system based on conventional technology would occupy a significantly larger area and require higher operating costs than a comparable wet cooling system capable of generating the same amount of cooling power. Hence, most large power plants, particularly those in hot and humid climate zones where traditional dry-cooling is impractical, utilize wet cooling systems that collectively consume enormous amounts of water (i.e., tens of billions of gallons of water per day). That is, when water is abundant and cheap, wet cooling systems can be significantly less expensive to build and operation than dry cooling systems based on conventional technology. However, in dry regions or regions experiencing curtailed water supplies (e.g., due to drought), the use of wet cooling systems can become problematic when precious water resources are necessarily diverted from residential or agricultural areas for use in a power plant.

Radiative cooling is a form of dry cooling in which heat dissipation is achieved by way of radiant energy. All objects constantly emit and absorb radiant energy, and undergo radiative cooling when the net energy flow is outward, but experience heat gain when the net energy flow is inward. For example, passive radiative cooling of buildings (i.e., radiative cooling achieved without consuming power, e.g., to turn a cooling fan) typically occurs during the night when long-wave radiation from the clear sky is less than the long-wave infrared radiation emitted from the building's rooftop. Conversely, during the daytime solar radiation directed onto the building's roof is greater than the emitted long-wave infrared radiation, and thus there is a net flow into the sky.

In simplified terms, the cooling power, Pcooling, of a radiating surface is equal to the radiated power, Prad, less the absorbed power from atmospheric thermal radiation from the air, Patm, the solar irradiance, Psun, and conduction and convection effects, Pcon:

$$Pcooling = Prad - Patm - Psun - Pcon \quad \text{(Equation 1)}$$

In practical settings, Patm is determined by ambient temperature, Psun varies in accordance with time of day, cloud cover, etc., and is zero at nighttime, and Pcon is determined by structural details of the cooler. From Equation 1, maximizing Pcooling during daytime entails increasing Prad by increasing the emissivity of the surface, minimizing the effect of Psun (e.g., by making use of a broadband reflector), and mitigating convection and conduction effects Pcon by way of protecting the cooler from convective heat sources. Assuming a combined non-radiative heat coefficient of 6.9 W/m2K, Eq. 1 thus yields a practical minimum target Prad value of 55 W/m2 during daytime, and 100 W/m2 during nighttime, which translates into a drop in temperature around 5° C. below ambient.

An ideal high-performance passive radiative cooler can thus be defined as a passive radiative cooling device that satisfies the following three conditions. First, it reflects at least 94% of solar light (mostly at visible and near-infrared wavelengths) to prevent the cooling panel from heating up, hence minimizing $P_{sun}$. Second, it exhibits an emissivity close to unity at the atmospheric transparency windows (e.g. 8-13 μm (dominant window), 16-25 μm, etc.) and zero emission outside these windows. This ensures that the panel doesn't strongly emit at wavelengths where the atmosphere is opaque, hence minimizing $P_{atm}$. Third, the device is sealed from its environment to minimize convection that would otherwise contribute to an additional heat load, hence minimizing $P_{conv}$. Convection on top of the device is a detriment in this case since it operates below ambient temperature. In short, an ideal high-performance passive radiative cooler is an engineered structure capable of "self-cooling" below ambient temperatures, even when exposed to direct sunlight, and requires no power input or material phase change to achieve its cooling power.

Currently there are no commercially available passive radiative cooling technologies that meet the three conditions defining an ideal high-performance passive radiative cooler. Existing radiative cooling foils can be inexpensive, but are currently limited to operating in the absence of sunlight (i.e., mostly at nighttime). Current state of the art attempts to achieve daytime passive radiative cooling utilize emitter-over-reflector architectures that require complex spectrally-selective emitter materials that are too expensive to provide commercially viable alternatives to traditional powered cooling approaches. Moreover, there are no (i.e., zero) passive radiative cooling technologies, commercial or otherwise, that are easily scalable to provide dry cooling for large power plants disposed in hot or humid regions. That is, the challenge for dry cooling of power plants is to design photonic structures that can be easily fabricated and scaled up to very large areas (e.g. 1 $km^2$) at low cost.

What is needed is a scalable high-performance passive (i.e., requiring no power/electricity input) radiative cooling system that can provide cost-effective dry cooling for power plants located in hot and humid climate zones or other regions experiencing curtailed water supplies where traditional dry-cooling remains impractical and/or where insufficient water is available to support the significant water consumption required by power plant wet cooling systems.

SUMMARY OF THE INVENTION

The present invention is directed to a low-cost, high-performance passive radiative cooling system in which a conduit structure causes a coolant (e.g., cooling water) to flow against a bottom surface of a metal sheet such that thermal energy (heat) is transferred from the coolant through the metal sheet to metamaterial nanostructures disposed on the sheet's top surface. The metamaterial nanostructures (i.e., subwavelength engineered structures with tailored optical properties) are arranged in an ultra-black metamaterial-based pattern on the top (first) surface of a metal sheet and configured to emit radiant energy at least in the primary atmospheric transparency window (i.e., having wavelengths in the range of 8 μm to 13 μm and/or in the range of 16 μm to 28 μm). To facilitate passive radiative cooling during both daytime and nighttime, a reflective layer is disposed over the metamaterial nanostructures that is configured to reflect incident solar radiation (i.e., to shield or shade the metal sheet such that the emitted radiant energy is predominantly converted thermal energy from the liquid coolant), where the reflective layer is also configured to transmit the emitted ATW radiant energy (i.e., such that the ATW radiant energy emitted from the metamaterial nanostructures passes through the reflective layer for transmission into cold near-space). With this arrangement, the passive radiative cooling system provides high-performance dry cooling that can be utilized by power plants in hot and humid climate zones and in regions experiencing curtailed water supplies, where traditional dry-cooling remains impractical, and/or where insufficient water is available to support the significant water consumption required by power plant wet cooling systems.

According to an aspect of the present invention, the three-layer (i.e., conduit-metal sheet/emitter-reflector) arrangement utilized by the cooling system facilitates dry cooling at significantly lower cost than is achievable any other existing conventional approach. The metal sheet serves both production and operating cost reducing purposes: first, it provides a potentially low-cost medium (e.g., when implemented using aluminum foil) for generating the required metamaterials-enhanced ultra-black pattern by facilitating the use of low-cost, high throughput fabrication processes (e.g., anodization and electroless plating); second, the metal sheet serves as a highly efficient thermal conductor of heat from the coolant to the metamaterials-enhanced ultra-black material, thus potentially reducing the total area occupied by the cooling system; and third, the metal sheet provides a reliable and durable moisture barrier that prevents the coolant from fouling the metamaterials-enhanced ultra-black material and/or reflective layer, which could impede emissions and/or radiative transfer. Next, mounting the reflective layer over the top surface of the metal sheet, an emitter-under-reflector arrangement is formed that also lowers production costs because this arrangement facilitates implementing the reflective layer using commercially available solar mirror films, thus avoiding the need for complex and expensive materials required by conventional emitter-over-reflector architectures. Finally, utilizing the bottom surface of the metal sheet to provide the upper wall of the conduit structure (i.e., such that the coolant contacts the bottom surface of the metal sheet as it passes through the conduit structure) simplifies and minimizes the material costs associated with the conduit structure, which further reduces overall production costs.

According to another aspect, high performance passive radiant cooling is achieved by way of metamaterial nanostructures that are arranged in an ultra-black metamaterial-based pattern such that the resulting ultra-black emitter is configured to emit ATW radiant energy with an emissivity close to unity, and by implementing the reflective layer using a material capable of reflecting at least 94% of incident solar radiation (i.e., solar radiation having a frequencies of 2 μm or less) while passing therethrough the emitted ATW radiant energy. In alternative embodiments, the ultra-black emitter is implemented using any of several metamaterial nanostructure types, including nanopores, or other needle-like, dendritic or porous textured surfaces, carbon nanotube forests, or other black films (e.g. black chrome, black silicon, black copper, nickel phosphorus (NiP) alloys). Because the reflective layer is disposed over the ultra-black emitter and reflects almost all incident solar radiation, the ultra-black emitter is shielded (shaded) from sunlight by the reflective layer during daylight hours, thus providing a passive radiative cooling system that exhibits superior passive radiative cooling power. Preliminary experimental results, based on estimates of net cooling power derived by solving the heat balance formula in Equation 1 (above) indicate low-cost passive radiative cooling system formed in accordance with the present invention provide net cooling powers approaching 75 $W/m^2$ and 130 $W/m^2$ during daytime and nighttime, respectively, and an early-stage prototype exhibited cooling of an aluminum substrate by 6° C. below ambient temperature in broad daylight, which is believed to be a record performance for daytime radiative cooling.

According to a presently preferred embodiment, the ultra-black emitter comprising an array of tapered nanopores disposed on the metal sheet, where each tapered nanopore is a pit-like cavity having an open upper end located at the top surface, a closed lower end, and a substantially conical-shaped side wall extending between the open upper end and the closed lower end. In one embodiment, the open upper end has a larger diameter than the closed lower end by way of increasing the applied voltage over time during anodization such that a diameter of the conic side wall decreases inside each tapered nanopore, and a reverse taper is produced by decreasing the applied voltage over time. The use of such tapered nanopores having a suitable size (e.g., having a nominal width in the range of 100 nm to 1 μm) facilitates the production of superior ultra-black materials capable of emitting ATW radiant energy with high emissivity because the tapered structures effectively have smoothly varying refractive indices (grated index medium) that prevent Fresnel reflections. In accordance with specific embodiments, the emitter layer of each passive radiative cooling panel includes both a base (first) metal material and a plated (second) metal layer that is disposed on the top surface of the first metal (base metal layer) such that a portion of the plated metal layer is disposed inside each of the tapered nanopores. In addition to impedance matching, such metal-coated tapered nanopores will also scatter light inside the ultra-black material, which significantly contributes to the emission of ATW radiant energy. In addition, the large imaginary part of the refractive index of the metal contributes to the attenuation of the light inside the material, producing low reflectance that will physically result in an extremely dark appearance of the surface. In an exemplary embodiment, the base metal layer is implemented using aluminum, and the plated (second) metal layer comprises one or more of nickel (Ni) copper (Cu) and gold (Ag). In a presently preferred embodiment, the metal-plated tapered nanopores are formed using a modified Anodic Aluminum Oxide (AAO) self-assembly template technique in which an aluminum sheet (metal sheet) is anodized in acid such that a porous alumina (aluminum oxide) layer forms over the aluminum sheet that includes self-formed, hexagonally packed arrays of nanopores, wherein formation of the alumina layer is controlled by way of varying the applied voltage in order to generate the desired taper. This AAO method provides a high-throughput, bottom-up, and low-cost fabrication method to fabricate subwavelength (e.g., sub-50 nm) and very high-aspect ratio (1:1000) tapered nanopores. Because passive radiative cooling inherently requires modules covering a large area (i.e., one or more square kilometers in large power plant applications), a main techno-economic challenge for developing a passive radiative cooling panel rests on the ability to cost-effectively mass-produce the panels. Next, a plated metal layer (e.g., Ni, Cu or Ag) is formed on the alumina (aluminum oxide) layer by way of a suitable plating process (e.g., electroless plating) such that the plating metal forms on the surfaces inside the tapered nanopores. In addition to impedance matching, the nickel/copper/gold metal-plating serves to scatter light inside the tapered nanopores, which significantly contributes to the emission of ATW radiant energy. In addition, the large imaginary part of the refractive index of the nickel/copper/gold metal-plating contributes to the attenuation of the light inside the tapered nanopores, producing low reflectance that will physically result in an extremely dark appearance of the surface. Therefore, the combination of aluminum-based tapered nanopores and nickel/copper/gold metal-plating facilitates the production of superior ultra-black emitters capable of generating ATW radiant energy with high emissivity. Moreover, by forming tapered nanopores formed using the novel modified AAO self-assembly template techniques described herein, and then electroless plating a second metal (e.g., Ni, Cu or Ag) onto the alumina, superior ultra-black materials are produced with high efficiency, and in a manner that facilitates low-cost mass production of passive radiative cooling systems using cost-effective roll-to-roll mass-production manufacturing techniques.

According to another embodiment of the present invention, the upper reflective layer of each module comprises a distributed Bragg reflector including multiple sublayers collectively configured to reflect (i.e., exhibit a reflectance of 0.8 or greater) incident solar radiation having wavelengths in the range of 0 to 2 μm, and to transmit/pass therethrough (i.e., exhibit a reflectance of 0.2 or lower) ATW radiant energy, for example, having wavelengths in the range of 8 μm to 13 μm. In some embodiments, commercially available solar mirror films currently used in concentrating solar power (CSP) collectors (e.g., solar films produced by 3M Corporation of St. Paul, Minn. USA, or by ReflecTech, Inc. of Arvada, Colo. USA) exhibit spectral characteristics that are close enough to the desired spectrum, and may be cost-effectively secured to the top surface of the emitter layer, e.g., by way of an optional intervening adhesive layer. In other embodiments that require a reflective layer that selectively transmits only ATW portions of the broadband radiant energy, custom engineered reflective layers may be required.

According to a presently preferred embodiment of the present invention, the conduit structure includes including a lower wall and a raised peripheral wall configured to collectively form a box-like frame having an open top that is covered (sealed) by the metal plate when the conduit structure is operably mounted onto the ultra-black emitter (i.e., such that the bottom surface of the metal plate, the upward facing surface of the lower wall, and the inward-facing surfaces of the peripheral wall surround/define a substantially enclosed region referred to herein as a "heat-exchange channel"). To facilitate the flow of coolant through the conduit structure, an inlet port is defined at one end of the box-like frame, and an outlet port is defined at the opposite end, whereby coolant enters the conduit structure through the inlet port, passes through the heat-exchange channel, and exits the conduit structure through the outlet port. Because the bottom surface of the metal plate forms the upper surface of the heat-exchange channel, the coolant necessarily flows against (i.e., contacts) the surface of the metal sheet as it passes through the heat-exchange channel, thereby facilitating heat transfer to the ultra-black emitter. Optional baffles are mounted on either the lower wall or the peripheral side walls of the box-like frame and are configured to direct the flow of coolant along narrow channel sections as it passes through the heat-exchange channel in order to enhance heat transfer to the ultra-black emitter. In alternative embodiments, low cost conduit structures are implemented using, for example, corrugated metal sheets.

According to another embodiment of the present invention, the metamaterials-enhanced passive radiative cooling system utilizes modular units (modules) and an associated flow control system that are configured to facilitate scalable dry cooling for power plants (or other objects). Each module has a substantially identically shaped (e.g., square or rectangular) structure including an associated ultra-black emitter unit (i.e., metal sheet having a fixed size, such as 1 $m^2$, with metamaterial nanostructures formed thereon as described above), a reflective layer portion (also mentioned above) sized and shaped to shield the emitter unit, and a conduit structure sized and shaped to fit substantially entirely under the emitter unit (i.e., such that the emitter unit is between coolant flowing through the conduit structure and the reflective layer). To facilitate series connection of multiple modules to form linearly arranged module row groups, each conduit structure includes an inlet port at one end and an outlet port at the opposite end that are positioned for easy connection (e.g., by way of intervening pipe sections) such that coolant exiting through the outlet port of one module enters the inlet port of an adjacent module in the same row group. In a practical embodiment, to facilitate dry cooling that can be economically scaled (selectively configured) to achieve a given target temperature drop of a given coolant flow volume, the flow control system utilizes one or more inflow pipes to supply heated coolant from the object to be cooled (e.g., a power plant) to one or more row groups of series-connected modules, one or more outflow pipes to return cooled coolant from the modules to the object to be cooled, and a pump operably coupled to one or both pipes and configured to generate fluid flow by applying an optimal pressure to bias (flow) the coolant through the modules at a desired rate. That is, the passive radiative cooling system is easily scalable to achieve a target temperature drop by way of adjusting the number of series-connected modules in each row group through which coolant must sequentially flow between the inflow and outflow pipes (i.e., because each module provides a unit amount of heat dissipation, the total heat dissipation, and hence temperature drop, of the coolant flowing from the inflow pipe to the outflow pipe is proportional to the number of modules the coolant passes through in each given row group). In addition, the passive radiative cooling system is scalable to achieve this target temperature drop for a given flow volume by connecting a sufficient number of row groups in parallel between the inflow and outflow pipes. Accordingly, the present invention provides a high-performance passive radiative cooling system that is scalable to provide cost-effective dry cooling for power plants of any size, even in hot and humid climate zones, where traditional dry-cooling remains impractical, and in regions experiencing curtailed water supplies, where insufficient water is available to support power plant wet cooling systems.

According to yet another embodiment of the present invention, a method for dry cooling an object includes circulating a coolant between the object and a heat-exchange channel formed such that the coolant flows against the bottom surface of a metal sheet before returning to the object, and dissipating thermal energy from the coolant by way of metamaterial nanostructures disposed in an ultra-black metamaterial-based pattern on a top surface of the metal sheet, where the metamaterial nanostructures are configured to convert the thermal energy into radiant energy having wavelengths in one or more atmospheric transparency windows and then transmitted through a solar radiation reflective layer into cold near-space. By converting thermal energy from the coolant into atmospheric transparency window radiant energy that is then transmitted through a reflective layer, the present invention provides a high-performance passive radiative cooling system capable of providing dry cooling for power plants in hot and humid climate zones, where traditional dry-cooling remains impractical, and in regions experiencing curtailed water supplies, where insufficient water is available to support power plant wet cooling systems.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in passive reflective cooling. The following description is presented to enable one of ordinary skill in the art to make and use the invention as provided in the context of a particular application and its requirements. As used herein, directional terms such as "upper", "upward-facing", "lower", "downward-facing", "top", and "bottom", are intended to provide relative positions for purposes of description, and are not necessarily intended to designate an absolute frame of reference. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
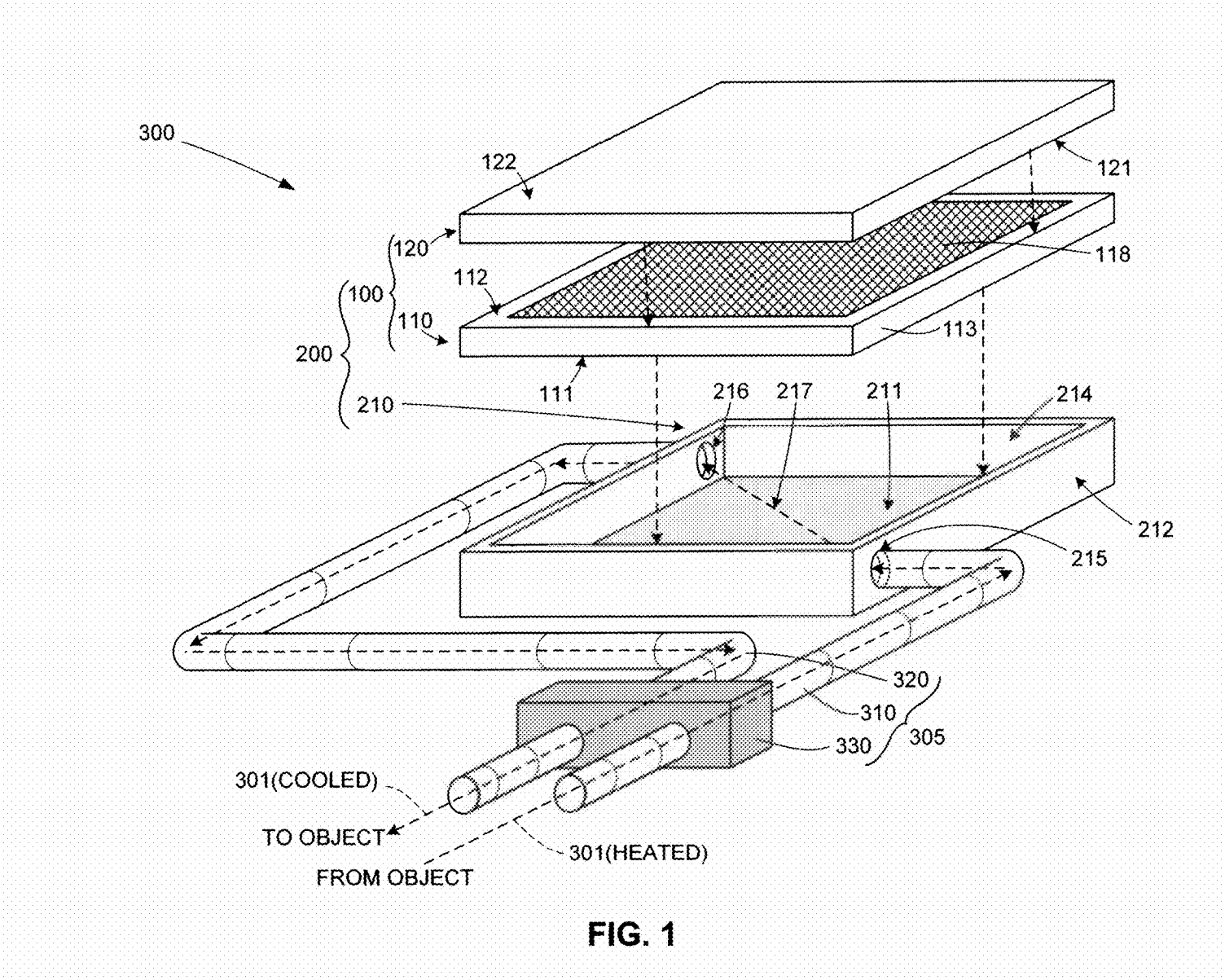
FIG. 1 is a top side perspective view showing a simplified passive radiative cooling system according to an exemplary embodiment of the present invention.
Figure 2:
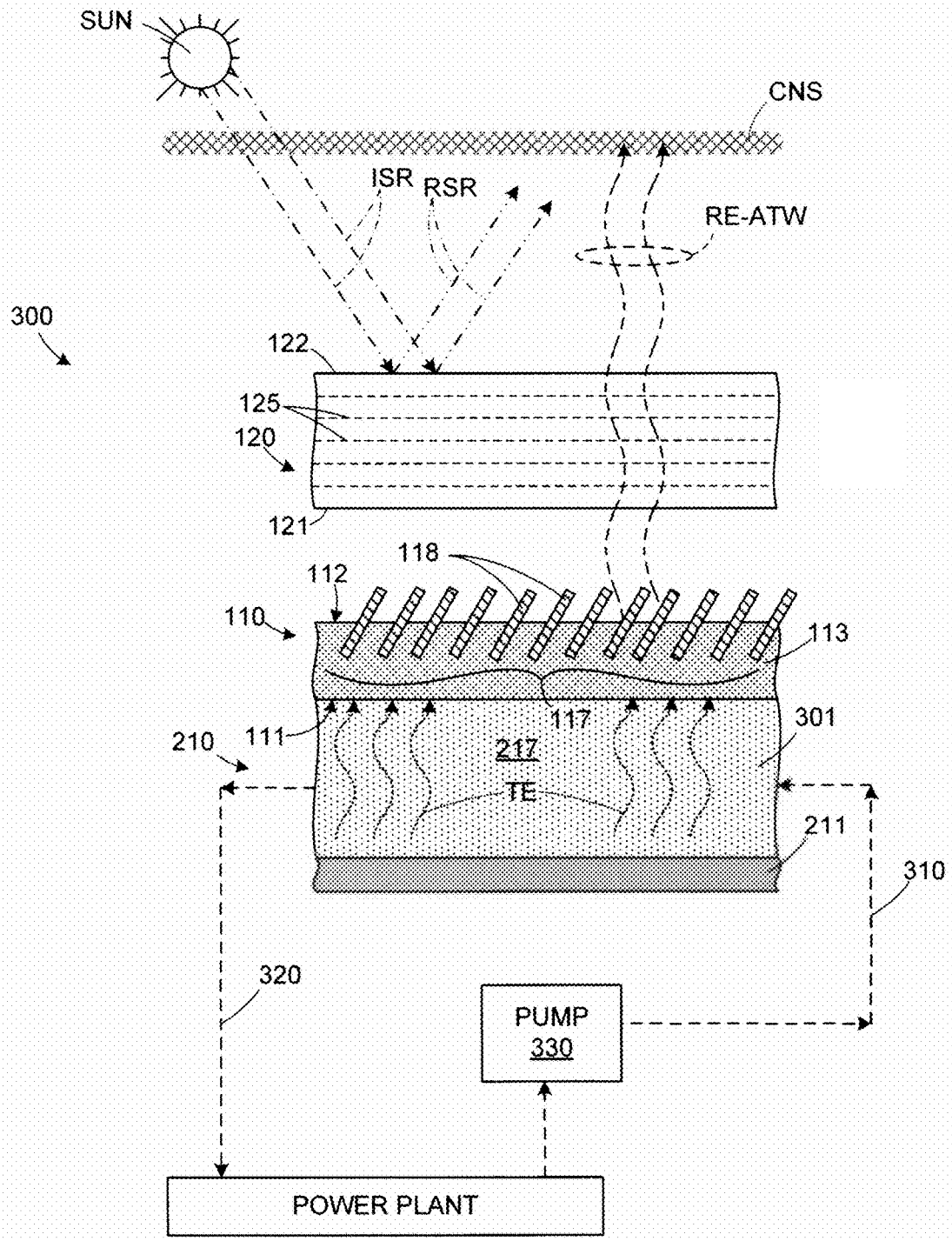
FIG. 2 is a simplified diagram showing the system of FIG. 1 during operation.

FIG. 1 is a perspective view showing an exemplary simplified passive radiative cooling system 300 according to a generalized embodiment of the present invention, and FIG. 2 is a partial exploded cross-sectional side view showing portions of system 300 in additional detail.

Figure 3:
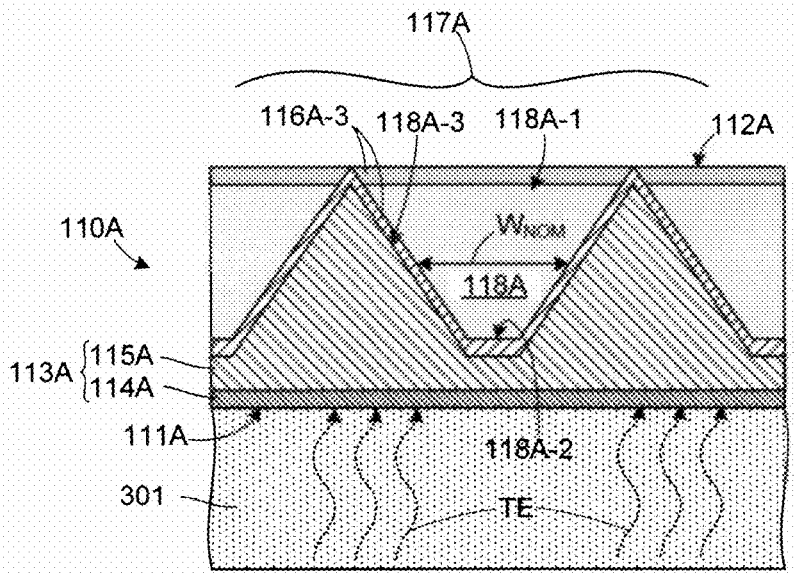
FIG. 3 is a cross-sectional side view showing a ultra-black material including metal-plated tapered nanopores formed using a modified AAO self-assembly technique according to a specific embodiment of the present invention.

Referring to the upper portion of FIG. 1, the primary components of passive radiative cooling system 300 include an ultra-black emitter 110 disposed between a conduit structure 210 a reflective layer 120. As explained in additional detail below, ultra-black emitter 110 generally comprises a metal sheet 113 having a bottom surface 111 and an opposing top (first) surface 112. Conduit structure 210 serves to direct the flow of a coolant (e.g., cooling water) 301 against and across bottom surface 111 of metal sheet 113 such that, as indicated in FIG. 2, thermal energy TE (heat) is transferred from coolant 301 through metal sheet 113 to metamaterial nanostructures 118. Ultra-black emitter 110 also includes metamaterial nanostructures 118 disposed in an ultra-black metamaterial-based pattern 117 on top surface 112 of metal sheet 113, where metamaterial nanostructures 118 are fabricated in a way that converts thermal energy TE from coolant 301 into atmospheric transparency window (ATW) radiant energy RE-ATW (i.e., infrared radiant energy having wavelengths in at least the primary ATW range of 8 μm to 13 μm, and optionally also in the secondary ATW range of 16 μm to 28 μm) such that radiant energy RE-ATW is then emitted from top surface 112 (i.e., upward away from conduit structure 210). As indicated in FIG. 2, reflective layer 120 serves two functions: first, it shields ultra-black emitter 110 by reflecting at least 94% of incident solar radiation ISR (as shown in FIG. 2) that would otherwise be applied onto ultra-black emitter 110; and, second, reflective layer 120 transmit radiant energy RE-ATW (i.e., such that radiant energy RE-ATW passes through reflective layer 120 such that, as shown in FIG. 3, radiant energy RE-ATW is transmitted through Earth's atmosphere and into cold near-space CNS).

In one embodiment the primary components of system 300 are implemented using modularized units referred to herein as modules 200. In this case, multiple modules are typically connected in parallel and/or series in the manner described below to provide scalability for achieving a target temperature drop for a given coolant volume flow rate. In a possible alternative embodiment, a single custom-built structure including features similar to those provided herein may be used in place of multiple modules 200.

Referring to the upper portion of FIG. 1, in one embodiment ultra-black emitter 110 and reflective layer 120 are produced as a laminated two-layered panel 100 before being attached to conduit structure 210. Although panel 100 may be assembled using the specific details of ultra-black emitter 110 and reflective layer 120 that are set forth below, panel 100 may also include any of the additional features and alternative material combinations that are described in co-owned and co-pending U.S. Pat. No. 9,927,188, entitled METAMATERIALS-ENHANCED PASSIVE RADIATIVE COOLING PANEL, which is incorporated by reference herein in its entirety.

In addition to the primary components discussed above, system 300 also includes a flow control system 305 that functions to circulate a given volume of a coolant 301 at a given flow rate between an object to be cooled (e.g., a power plant, not shown) and the primary components discussed above, whereby the coolant's temperature is decreased by a target temperature amount (target temperature drop) as it passes through the primary components. In the exemplary embodiment depicted in FIG. 1, flow control system 305 includes an inflow pipe 310 through which heated coolant 301 flows from the object to conduit structure 210, an outflow pipe 320 through which cooled coolant 301 is returned from conduit structure 210 to the object, and an optional pump 330 that is operably coupled to one or both of inflow pipe 310 and outflow pipe 320, and configured to generate the desired rate of coolant flow through conduit structure 210. As set forth below, flow control system 305 is scalable using known techniques to facilitate a required volume and flow rate of coolant 301, which generally varies in accordance with the size and type of object to be cooled. Similarly, the primary components of system 300 (i.e., one or more ultra-black emitters 110, one or more reflective layers 120, and one or more conduit structures 210) are scalable both to achieve the target temperature drop and to accommodate the required volume and flow rate of coolant 301 either by way of series/parallel connection of multiple modules 200, or by providing one or more custom-sized primary component assemblies, each including features similar to module 200.

FIG. 2 shows system 300 during daylight operation (i.e., while incident solar radiation ISR is directed by the sun onto upper surface 122 of reflective layer 120). In a practical setting, panel 100 is oriented in a horizontal plane such that a bottom surface 111 of emitter 110 faces the ground (i.e., faces downward), and upper surface 122 of reflective layer 120 faces the sky (i.e. upward). Referring the lower portion of FIG. 2, emitter layer 110 includes a base material layer 113 having bottom surface 111 and an opposing top surface 112 that faces a lower (downward-facing) surface 121 of reflective layer 120. Note that emitter 110 is illustrated as separated from reflective layer 120 in FIG. 2 for descriptive purposes, and that top surface 112 typically contacts lower surface 121. Radiant energy RE-ATW is then transmitted from upper surface 122 through the lower atmosphere from the Earth's surface into cold near-space CNS. That is, because radiant energy RE-ATW has frequencies associated with one or more atmospheric transparency windows, it passes directly through Earth's atmosphere without absorption and re-emission (i.e., without heating the atmosphere above panel 100) and into space, thereby allowing system 300 to produce a net cooling effect even during daytime hours.

Figure 4:
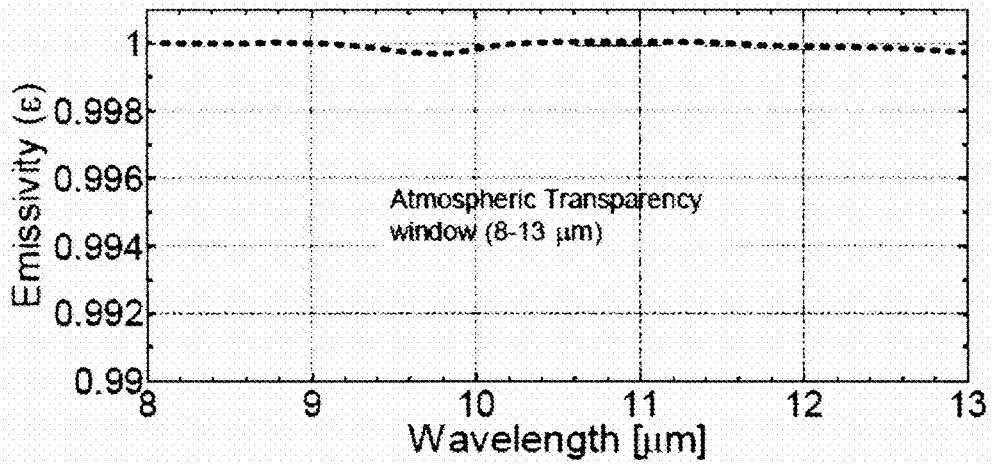
FIG. 4 is a diagram depicting exemplary optical properties of an emitter layer utilized in the emitter layer of FIG. 3.

According to alternative embodiments, ultra-black emitter 110 is implemented using any of several metamaterial nanostructure types. In the generalized embodiment shown in FIG. 2, metamaterial nanostructures 118 are illustrated in a symbolic manner that may include nanopores, carbon nanotube forests, nanostructured coatings (e.g., black silicon), nickel phosphorus (NiP) alloys, or other structures known to produce ultra-black materials. In a presently preferred embodiment shown in FIG. 3, an emitter layer 110A includes metal-plated tapered nanopores 118A formed on a base material layer (metal sheet) 113A that includes an aluminum layer 114A and an aluminum oxide layer 115A disposed on the aluminum layer 114A, wherein tapered nanopores 118A are entirely defined within aluminum oxide layer 115A. Emitter layer 110*a* is fabricated using a modified Anodic Aluminum Oxide (AAO) self-assembly template technique in which aluminum layer 114A is anodized in acid to form porous alumina (aluminum oxide) layer 115A thereon such that the alumina layer 115A includes self-formed, hexagonally packed arrays of tapered nanopores. By gradually changing the process parameters during anodization, tapered nanopores 118A are thus fabricated entirely during the alumina formation process. The pitch and diameter (nominal width WNOM) of each tapered nanopore 118A formed by this method are dependent in part on the anodization voltages and process conditions and determined by target optical properties. To generate ATW radiant energy, nominal widths WNOM of tapered nanopores 118A are typically in the range of 100 nm to 1 micron. The height of each nanopore is controlled by the anodization time. This AAO method is a high-throughput, bottom-up, and low-cost fabrication method to fabricate subwavelength (e.g., sub-50 nm) and very high-aspect ratio (1:1000) tapered nanopores. Because passive radiative cooling inherently requires a large area (i.e., square kilometers) of panels when it comes to practical applications, such as power plant dry cooling, a main techno-economic challenge for developing a passive radiative cooling panel rests on the ability to cost-effectively mass-produce the panels. By forming emitter layer 110A with tapered nanopores 118A using the AAO self-assembly template technique, and then electroless plating a second metal 116A (e.g., Ni, Cu or Ag) onto alumina layer 115A in the manner described above, superior metal-coated tapered nanopores are produced with high efficiency, and in a manner that facilitates low-cost mass production of modules using cost-effective roll-to-roll mass-production manufacturing techniques. The dashed line in FIG. 4, which indicates emissivity values generated using finite element method (FEM) simulations, shows that ultra-black emitter 110A exhibits an emissivity close to unity in the atmospheric transparency window of 8 μm to 13 μm. Additional details regarding the production of panel 100A are provided in co-owned and co-pending U.S. patent application Ser. No. 14/740,032, entitled PRODUCING PASSIVE RADIATIVE COOLING PANELS AND MODULES, which is incorporated by reference herein in its entirety.

Figure 5:
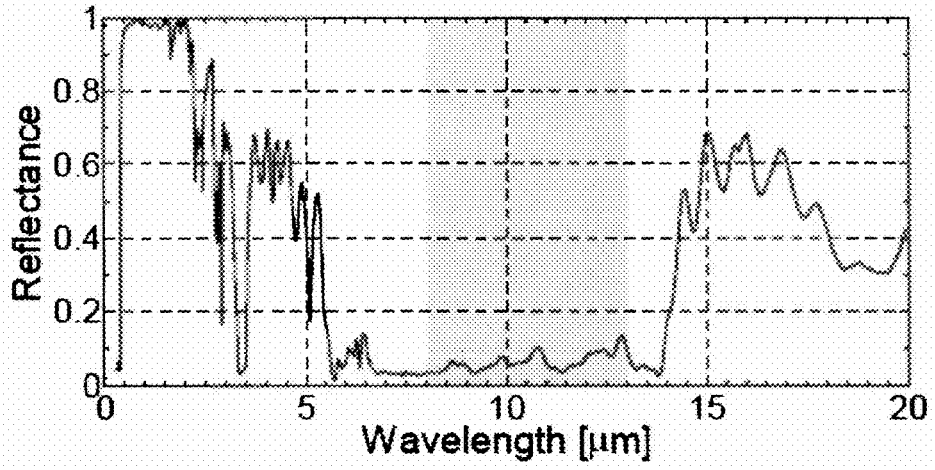
FIG. 5 is a diagram depicting optical properties of the upper reflective layer utilized in the passive radiative cooling system of FIG. 1.

Referring again to FIG. 2, reflective layer 120 functions to shield emitter 110 from solar radiation by reflecting incident solar radiation ISR directed onto upward-facing surface 122 while simultaneously transmitting therethrough (i.e., passing from downward-facing surface 121 to upward-facing surface 122) at least radiant energy portion RE-ATW, which is emitted upward from emitter layer 110. In one embodiment, reflective layer 120 is configured to reflect at least 94% of incident solar radiation ISR. In a preferred embodiment, reflective layer 120 comprises a distributed Bragg reflector including multiple sublayers 125 collectively configured to reflect incident solar radiation and to transmit therethrough ATW radiant energy with characteristics similar to those depicted in the graph shown in FIG. 5. That is, in the preferred embodiment, reflective layer 120 exhibits reflectance of incident solar radiation ISR having wavelengths in the range of 0 to 2 μm with a reflectance value of 0.8 or greater, and effectively transmits/passes therethrough ATW energy portion RE-ATW (i.e., exhibit a reflectance of 0.2 or lower for radiant energy at least in the primary ATW of 8-13 μm). In some embodiments, commercially available solar mirror films currently used in concentrating solar power (CSP) collectors (e.g., solar films produced by 3M Corporation of St. Paul, Minn. USA, or by ReflecTech, Inc. of Arvada, Colo. USA) exhibit spectral characteristics that are close enough to the desired spectrum, and may be cost-effectively secured to the top surface 112 of the emitter layer 110, e.g., by way of an optional intervening adhesive layer. In other embodiments that require a reflective layer that selectively transmits only ATW radiant energy, custom engineered reflective layers may be required.

Referring to the central portion of FIG. 1, conduit structure 210 includes a lower wall 211 and a raised peripheral wall 212 configured to collectively form a box-like frame having an open top 214. As indicated in FIG. 2, the open top becomes covered (sealed) by metal plate 113 when conduit structure 210 is operably mounted onto ultra-black emitter 110. A heat-exchange channel 217 is defined by (i.e., is a substantially hollow region surrounded by) bottom surface 111 of metal plate 113, the upward facing surface of the lower wall 211, and the inward-facing surfaces of the peripheral wall 212. To facilitate the flow of coolant through the conduit structure 210, an inlet port 215 is defined at one end of the box-like frame, and an outlet port 216 is defined at the opposite end. During operation, coolant 301 enters conduit structure 210 through inlet port 215, passes through heat-exchange channel 217, and exits conduit structure 210 through outlet port 216. Because bottom surface 111 of metal plate 113 forms the upper surface of heat-exchange channel 217, coolant 301 necessarily flows against (i.e., contacts) bottom surface 111 as it passes through heat-exchange channel 217, thereby facilitating heat transfer to ultra-black emitter 110 for conversion into radiant energy RE-ATW.

Figure 6:
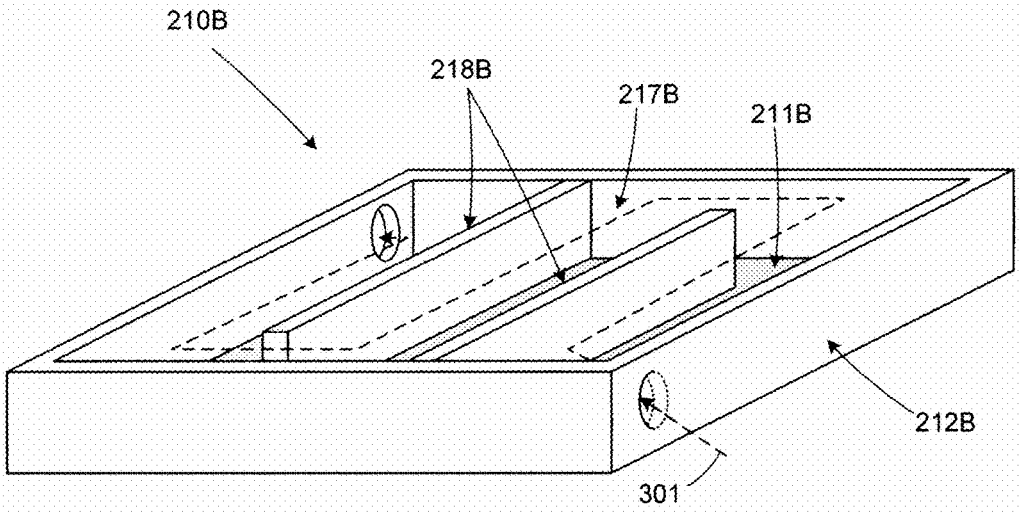
FIG. 6 is a top side perspective view showing a conduit structure utilized by a passive radiative cooling system according to another exemplary embodiment of the present invention.

FIG. 6 is a perspective view showing a conduit structure 210B according to an alternative embodiment of the present invention in which optional baffles 218A are mounted inside heat-exchange channel 217B (e.g., either connected to lower wall 211A or peripheral side walls 212A) and are configured to direct the flow of coolant 301 along narrow channel sections (as indicated by the dashed-line arrows in FIG. 6) as it passes through heat-exchange channel 217A in order to enhance heat transfer the ultra-black emitter (not shown).

As mentioned above, in a presently preferred embodiment, the passive radiative cooling system of the present invention is implemented using multiple modular units (modules) that are connectable in series to achieve a target coolant temperature drop for a given coolant volume and flow rate. FIG. 1 depicts this module-based system in a simplified form using a single module 200, where flow control system 305 utilizes inflow pipe 310 to transmit (conduct) heated coolant 301 from an object (e.g., a power plant) to module 200, and utilizes outflow pipe 320 to transmit cooled coolant 301 for return to the object, and optional pump 330 that is operably coupled to one or both of inflow pipe 310 and outflow pipe 320, and configured to generate the desired rate of coolant flow through module 200. As depicted by the simplified arrangement in FIG. 1, inflow pipe 310 is operably coupled to inlet port 215, which is defined in a wall (e.g., peripheral side wall 212) of conduit structure 210 and serves as an input to module 200, whereby coolant 301 flows into heat-exchange channel 217. Similarly, outlet port 216 is operably coupled to outflow pipe 320 such that coolant 301 exiting module 200 passes from heat-exchange channel 217 to outflow pipe 320. By producing module 200 with a given "standard" size (e.g., with panel 100 having a unit coverage area of 1 $m^2$ and with heat-exchange channel 217 having a volume of 1 liter), the number and arrangement of modules 200 required to provide sufficient cooling power for a given object (e.g., power plant) can be readily determined for a target coolant temperature drop and coolant volume/flow rate. The temperature difference of coolant 301 between inflow pipe 310 and outflow pipe 320 thus depends on the net cooling power of each module 200, the total coverage area, the hydraulic geometry and size, the fluid flow rate, the water temperature, and the conduction losses. By properly sizing inflow pipe 310 and outflow pipe 320 and connecting a sufficient number of modules 200 of a given standard size in the manner described below with reference to FIGS. 7 and 8, module-based system 300 is easily scalable to provide sufficient cooling power to achieve a target temperature drop for any volume/flow rate of coolant. Based on preliminary experimental results using a prototype, water temperature drops of 8° C. are believed to be achievable. Using a system comprising modules covering 1 $km^2$ (~10 MW of total radiative cooling power), with a typical closed-loop flow rate of $10^5$ gal/min, each module processes approximately 30 gal/min for a suitable parallel distribution of water flow, resulting in less than 1 psi of pressure drop per panel. This translates to the use of a pump having a hydraulic power of approximately 1.3 MW, which represents less than 0.5% increase in the hydraulic power of a 500 MW power plant. This is easily offset by the cooling water temperature drop, leading to a net plant efficiency gain of approximately 3%.

Figure 7:
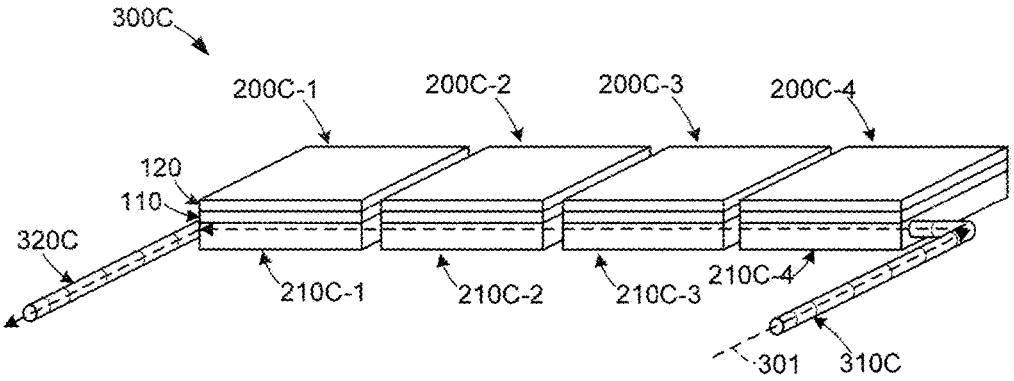
FIG. 7 is top side perspective view showing an exemplary row group including four modules connected between inflow and outflow pipes according to another exemplary embodiment of the present invention.

FIG. 7 shows a simplified exemplary passive radiative cooling system 300C that illustrates how multiple modules are connected in series to achieve a target temperature drop. Each module 200C-1 to 200C-4 is configured in the manner described above with reference to FIG. 1 (e.g., module 200C-1 includes an ultra-black emitter 110C and a reflective layer 120C disposed over an associated conduit structure 210C-1). For illustrative purposes, system 300C includes a row group made up of four modules 200C-1, 200C-2, 200C-3 and 200C-4 operably connected in series (e.g., such that the outlet port of modules 200C-1 is connected to the inlet port of adjacent module 200C-2 by way of a short intervening pipe, not shown) between an inflow pipe 310C and an outflow pipe 320C such that, as indicated by the dashed-line arrows, coolant 301 passes from inflow pipe 310C to the inlet port of module 200C-1, through conduit structure 210C-1 of module 200C-1 to the inlet port of module 200C-2, through conduit structure 210C-2 to the inlet port of module 200C-3, through conduit structure 210C-3 to the inlet port of module 200C-4, and through conduit structure 210C-4 to outflow pipe 320C. Because each module 200C-1 to 200C-4 dissipates an associated unit amount heat from coolant 301 as coolant 301 sequentially passes through conduit structures 210C-1 to 210C-4, the total amount of heat dissipated and the resulting temperature drop of coolant 301 is proportional to the number of series connected modules. That is, to achieve a higher target temperature drop for a given flow rate, additional modules (i.e., more than four) would be added to the row group illustrated in FIG. 7. Accordingly, passive radiative cooling system 300C is easily scalable to achieve a target temperature drop by way of adjusting the number of series-connected modules through which coolant 301 must sequentially flow between inflow pipe 310C and outflow pipe 320C.

Figure 8:
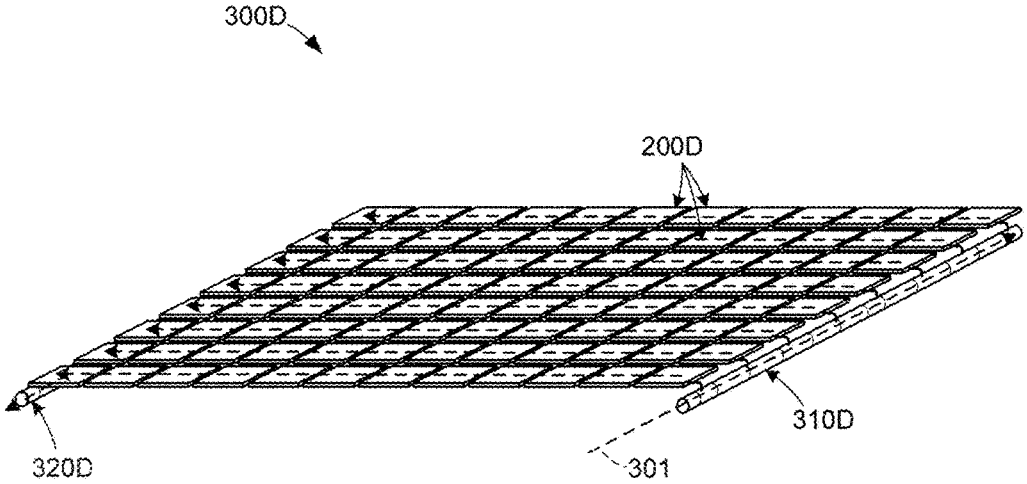
FIG. 8 is top side perspective view showing multiple row groups connected in parallel between inflow and outflow pipes according to another exemplary embodiment of the present invention.

FIG. 8 shows another partial exemplary passive radiative cooling system 300D in which multiple modules 200D, each configured in accordance with any of the embodiments described above, are operably connected to form multiple series-connected row groups that in turn are connected in parallel between an inflow pipe 310D and an outflow pipe 320D, whereby coolant 301 simultaneously passes from inflow pipe 310D through each of the row groups to outflow pipe 320D (i.e., as depicted by the dashed-line arrows). Because each row group is capable of processing a finite volume of coolant 301, when the required coolant flow volume exceeds the capacity of a single row group, multiple row groups are utilized in parallel as depicted in FIG. 8 to provide the required cooling power. That is, passive radiative cooling system 300D is scalable to achieve a target temperature drop for a given flow volume by connecting a sufficient number of row groups in parallel between inflow pipe 310D and outflow pipe 320D. The ability to easily connect multiple modules into arrays such as those shown in FIG. 8 makes the passive radiative cooling systems of the present invention economically viable and rapidly deployable to regions at risk of experiencing curtailed water supplies for power plant cooling in the near future. The proposed technology would also enable dry-cooling for power plant sites in hot and humid climate zones, where traditional dry-cooling remains impractical. The net impact is well illustrated by looking at the 13.9 Quads of electricity produced in the U.S. in 2013, where 90% of this generation capacity is based on thermoelectric processes that require cooling. Assuming an average conversion efficiency of 35%, this number swells to approximately 35.7 Quads of primary energy consumed. Passive radiative cooling systems configured in a manner similar to system 300D (FIG. 8) haves the potential to save up to 1 Quad of primary energy for electricity generation and 10s of billions of gallons of water per day needed for wet cooling. This will directly help to alleviate operational and economic impacts of cooling water curtailment within the U.S., and reduce adverse thermal environmental impacts.

Figure 9:
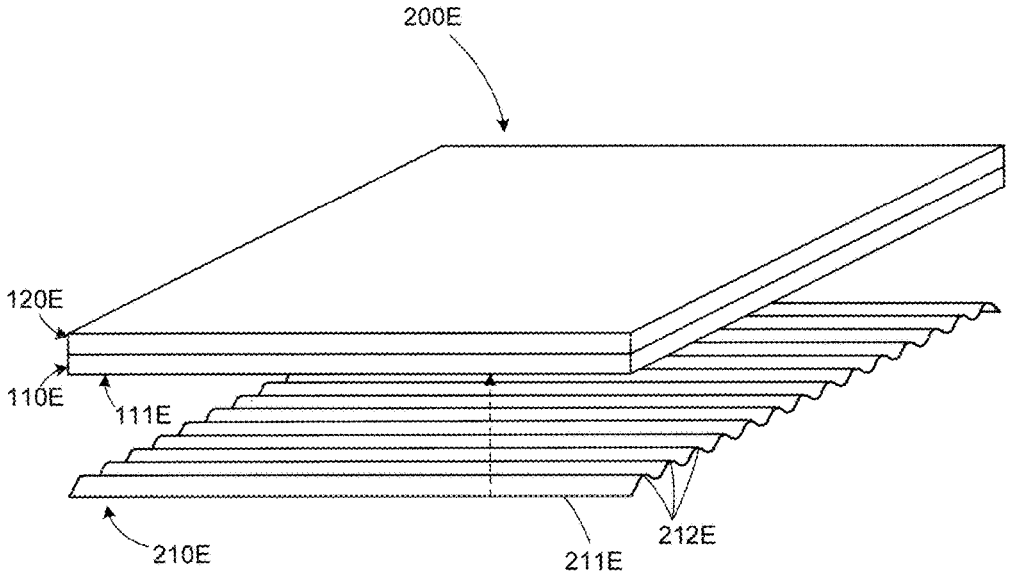
FIG. 9 is a top side perspective view showing a conduit structure according to another exemplary embodiment of the present invention.
Figure 10:
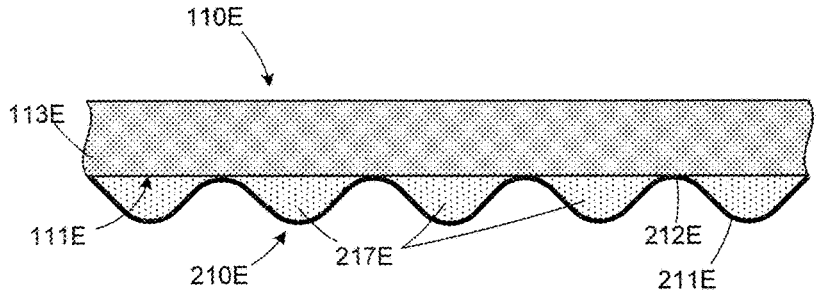
FIG. 10 is a simplified cross-sectional side view showing a portion of the conduit structure of FIG. 9 during operation.

Although the present invention has been described with respect to certain specific embodiments, it will be clear to those skilled in the art that the inventive features of the present invention are applicable to other embodiments as well, all of which are intended to fall within the scope of the present invention. For example, other types of conduit structures can be used in place of the box-like conduit structures described above to further minimize production costs. FIGS. 9 and 10 are exploded perspective and partial cross-sectional side views showing a module 200E including a conduit structure 210E formed by an inexpensive (e.g., metal) corrugated sheet 211E. Specifically, FIG. 9 shows an ultra-black emitter 110E and a reflective layer 120E formed in accordance with any of the examples set forth above, and corrugated sheet 211E immediately before attachment to ultra-black emitter 110E (i.e., as indicated by the vertical dashed-line arrow). As indicated in FIG. 10, after assembly of module 200E is completed, conduit structure 210E is attached (e.g., glued or otherwise operably secured) to bottom surface 111E of metal sheet 113E along parallel raised ridges 212E such that parallel heat-exchange channels 217E are defined between an upward-facing surface of corrugated sheet 211E and bottom surface 111E of metal sheet 113E. Moreover, the dry cooling method described herein may be implemented in spirit using structures other than those described above so long as coolant is caused to flow against one side of a metal sheet before returning to the object, and so long as heat is dissipated from the coolant in the form of atmospheric transparency window radiant energy by way of metamaterial nanostructures disposed in an ultra-black metamaterial-based pattern on the opposite surface of the metal sheet, and the radiant energy is transmitted through a solar radiation reflective layer into cold near-space.

The invention claimed is:

1. A passive radiative cooling system comprising:

a metal sheet having a plurality of metamaterial nanostructures disposed on a first surface thereof;

a reflective layer mounted over the first surface of the metal sheet; and a conduit structure disposed under the metal sheet and configured to conduct a coolant such that the coolant flows against a second surface of the metal sheet, whereby thermal energy is conducted from the coolant through the metal sheet to said plurality of metamaterial nanostructures, wherein said plurality of metamaterial nanostructures are arranged in an ultra-black metamaterial-based pattern and configured to emit radiant energy having wavelengths in the range of 8 μm to 13 μm; and wherein said reflective layer is configured both to reflect incident solar radiation and to transmit said radiant energy, wherein said plurality of metamaterial nanostructures comprises an array of tapered nanopores disposed on the top surface of the metal sheet, and wherein a nominal width of each said tapered nanopore is less than 1 micron.

2. The passive radiative cooling system according to claim 1, wherein the plurality of metamaterial nanostructures are further configured to generate said radiant energy having wavelengths in the range of 16 μm to 28 μm.

3. The passive radiative cooling system according to claim 1, wherein said metal sheet comprises a first metal, and wherein a plated metal layer is disposed on the upward-facing surface of the metal sheet and inside each said tapered nanopore, said plated metal layer comprising a second metal different from the first metal.

4. The passive radiative cooling system of claim 3, wherein said metal sheet comprises aluminum, and wherein said plated metal layer comprises one or more of nickel (Ni) copper (Cu) and gold (Ag).

5. The passive radiative cooling system of claim 4, wherein said metal sheet comprises aluminum base layer and an aluminum oxide layer disposed on the aluminum base layer, wherein said tapered nanopores are entirely defined within said aluminum oxide layer, and wherein said plated metal layer is entirely disposed on a surface of said aluminum oxide layer.

6. The passive radiative cooling system of claim 1, wherein the reflective layer comprises a plurality of sublayers forming a distributed Bragg reflector that is configured to reflect incident solar radiation having wavelengths in the range of 0 to 2 μm, and configured to pass therethrough radiation having wavelengths in the range of 8 μm to 13 μm.

7. The passive radiative cooling system of claim 1, wherein the conduit structure comprises a box-like frame including a lower wall and peripheral side walls, and wherein the conduit structure is fixedly connected to the metal sheet such that the lower wall and peripheral side walls of the conduit structure and the second surface of the metal sheet form a substantially enclosed heat-exchange channel configured to facilitate said coolant flow against said second surface of the metal sheet.

8. The passive radiative cooling system of claim 7, wherein one of said lower wall and said peripheral side walls define an inlet port configured to facilitate flow of said coolant into said heat-exchange channel, and an outlet port configured to facilitate flow of said coolant out of said heat-exchange channel.

9. The passive radiative cooling system of claim 8, wherein the conduit structure further includes a plurality of baffles mounted on one of said lower wall and said peripheral side walls configured such that a flow direction of said coolant through said heat-exchange channel is controlled by said plurality of baffles.

10. The passive radiative cooling system of claim 1, wherein the conduit structure comprises a corrugated sheet attached to the second surface of the metal sheet such that a plurality of parallel heat-exchange channels are defined between an upward-facing surface of said conduit structure and said second surface of the metal sheet.

11. A passive radiative cooling system comprising:

a plurality of modules, each said module including:

an ultra-black emitter including a metal sheet and a plurality of metamaterial nanostructures arranged in an ultra-black metamaterial-based pattern on a first surface of the metal sheet, said plurality of metamaterial nanostructures being configured to emit radiant energy having wavelengths in the range of 8 μm to 13 μm;

a reflective layer mounted on the first surface of the emitter layer and configured to reflect incident solar radiation; and a conduit structure disposed under the metal sheet emitter layer and configured to conduct a coolant between an inlet port and an outlet port such that thermal energy is conducted from the coolant through the metal sheet to said plurality of metamaterial nanostructures; and a flow control system configured to pass said coolant through said plurality of modules, wherein said metal sheet comprises aluminum base layer and an aluminum oxide layer disposed on the aluminum base layer, wherein said plurality of metamaterial nanostructures comprises an array of tapered nanopores entirely defined within said aluminum oxide layer, wherein said ultra-black emitter further comprises a plated metal layer entirely disposed on said aluminum oxide layer and inside each said tapered nanopore, and wherein said plated metal layer comprises one or more of nickel (Ni) copper (Cu) and gold (Ag).

12. The passive radiative cooling system of claim 11, wherein the conduit structure comprises a box-like frame including a lower wall and peripheral side walls defining an upper opening, wherein the conduit structure is fixedly connected to the metal sheet such that the lower wall and peripheral side walls of the conduit structure and the second surface of the metal sheet form a substantially enclosed heat-exchange channel configured to facilitate said coolant flow against said second surface of the metal sheet, and wherein one of said lower wall and said peripheral side walls define said inlet port and said outlet port.

13. The passive radiative cooling system of claim 11, wherein flow control system comprises an inflow pipe configured to conduct heated coolant from an object to said plurality of modules, an outflow pipe configured to conduct cooled coolant from said plurality of modules to said object, and a pump operably coupled to at least one of said inflow pipe and said outflow pipe.

14. The passive radiative cooling system of claim 13, wherein a first row group of said plurality of modules are operably connected in series between said inflow pipe and said outflow pipe such that said coolant passes from said inflow pipe sequentially through the conduit structure of each said module of said first row group to said outflow pipe.

15. The passive radiative cooling system of claim 14, wherein one or more second row groups of said plurality of modules are operably connected in series between said inflow pipe and said outflow pipe such that said coolant simultaneously passes in parallel from said inflow pipe through said first row group and said one or more second row groups to said outflow pipe.

* * * * *